United States Patent [19]

Sohn et al.

[11] 4,121,400

[45] Oct. 24, 1978

[54] APPARATUS FOR AND METHOD OF COMPACTING CONTENTS IN AND FILLING LIQUID INTO CONTAINERS

[75] Inventors: Donald F. Sohn, Rolling Meadows; Ernest L. Doering, Arlington Heights, both of Ill.

[73] Assignee: Standard Metal Products Co., Franklin Park, Ill.

[21] Appl. No.: 811,872

[22] Filed: Jun. 30, 1977

[51] Int. Cl.[2] ..... B65B 3/04; B65B 3/18; B65B 25/04

[52] U.S. Cl. ..... 53/436; 53/474; 53/527; 53/239

[58] Field of Search ..... 53/24, 35, 36, 124 B, 53/239, 252, 258

[56] References Cited

U.S. PATENT DOCUMENTS

| | | | |
|---|---|---|---|
| 1,673,236 | 6/1928 | Fleischer | 53/124 B |
| 2,656,963 | 10/1953 | Krueger | 53/239 X |
| 2,837,127 | 6/1958 | Luther | 53/239 X |
| 3,321,887 | 5/1967 | Manas | 53/239 X |
| 3,439,469 | 4/1969 | Van Mil | 53/239 X |

*Primary Examiner*—Robert Louis Spruill

*Attorney, Agent, or Firm*—Hill, Gross, Simpson, Van Santen, Steadman, Chiara & Simpson

[57] ABSTRACT

An apparatus and method according to which articles such as pickles are packed into open top containers such as jars and concurrently with operation of a compacting device filled with a desired liquid. By way of example while pickles are pressed into jars brine is filled into the jars, thereby avoiding the necessity of brining means separare from the pickle packing apparatus.

22 Claims, 10 Drawing Figures

44a
44
45
44b
44c
44d

APPARATUS FOR AND METHOD OF COMPACTING CONTENTS IN AND FILLING LIQUID INTO CONTAINERS

This invention relates to improvement in packing articles into open top containers and filling the containers with liquid, and is more particularly concerned with packing comestibles such as pickles into jars and filling the jars with liquid such as brine.

Some articles packed into open top containers require filling into the packed containers a desired liquid. By way of specific example, certain comestibles such as pickles must be compacted by pressing them down into the containers such as glass jars, and a desired liquid, such as brine in the case of pickles, must be filled into the containers to immerse the container contents. By way of example, the invention may be embodied in a pickle packing machine of the kind disclosed in Zellman U.S. Pat. No. 3,919,828 issued Nov. 18, 1975. According to that patent pickles are pressed into glass jars by means of a plunger assembly adapted for partial insertion into the jars, an inclined camming surface controlling the plunger assembly as the plunger assembly is caused to move in a cyclical circular path over a turntable supporting upwardly opening pickle jars loaded with pickles which are pressed into the jars by the respective plungers and the jars then moving on from the machine and filled with brine at a subsequent station.

An important object of the present invention is to eliminate the need for a separate liquid adding or brining station, but to effect not only the packing in of the articles into the containers but concurrently therewith filling a desired liquid into the containers, so that when the containers leave the packing apparatus they are ready to be capped and passed on to a cooking process where necessary.

According to features of the invention there is provided an apparatus for packing articles in an open top container and concurrently filling the container with liquid, comprising means for pushing the articles down in the containers, and means operating to substantially fill the container with article immersing liquid while the articles are being pushed down in the container by the pushing means.

According to other features of the invention there is provided a method of packing articles into an open top container and concurrently filling liquid into the container, comprising pushing the articles into the container, and during such pushing of the articles substantially filling the container with article-immersing liquid.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure, and in which.

Figure 1:
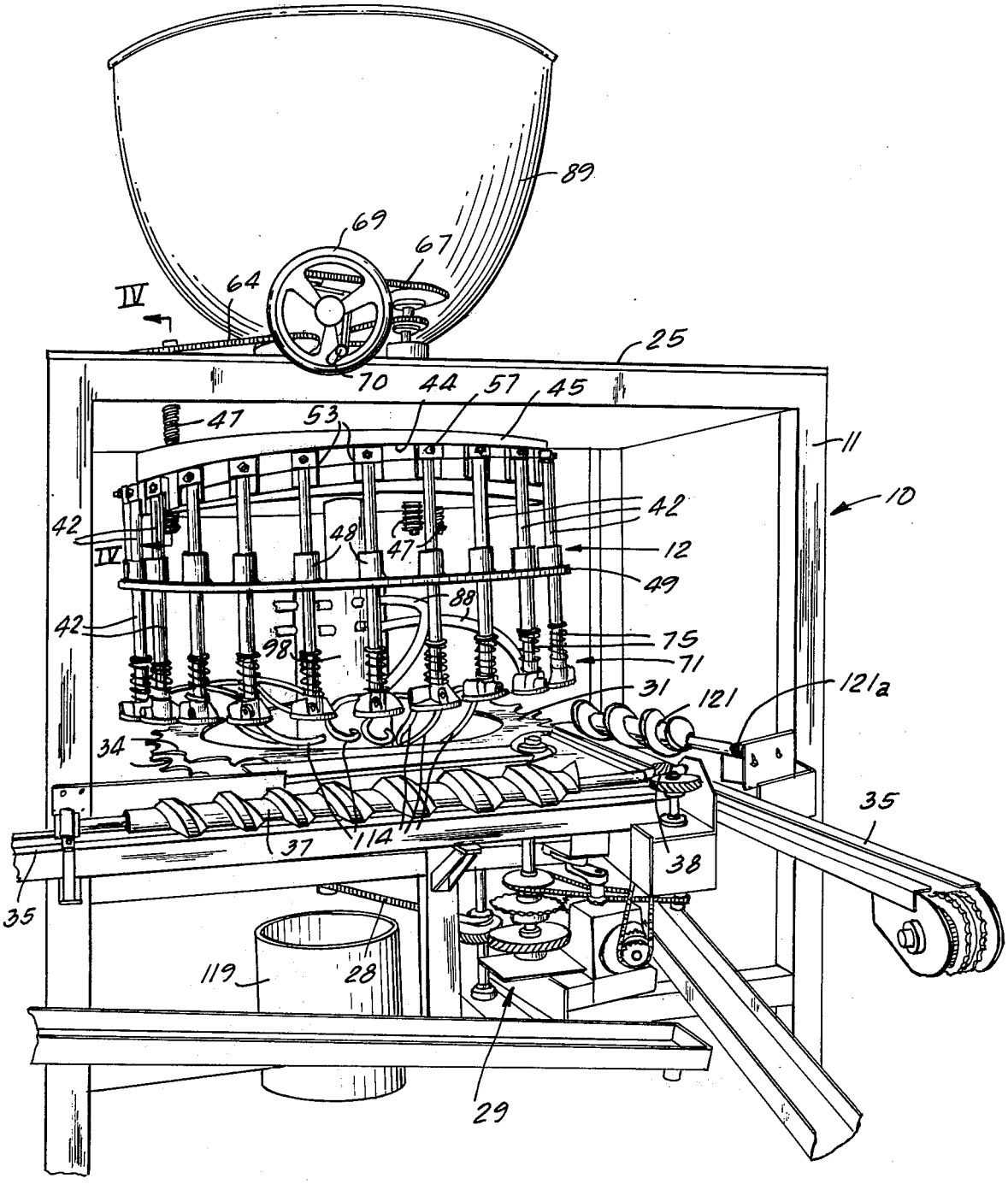
FIG. 1 is a perspective front elevational view of apparatus comprising a pickle packing machine embodying features of the invention.

Apparatus embodying the invention comprises, by way of example, a pickle packing machine 10 (FIGS. 1 and 2) which incorporates certain basic features of the aforementioned U.S. Pat. No. 3,919,828 which to any extent necessary is incorporated herein by reference. A main frame structure 11 supports all of the operating mechanisms of the machine. Within the frame 11 is rotatably supported a carousel-like carriage 12 which is adapted to receive a continuous succession of upwardly opening containers 13 such as glass jars provided with reduced diameter necks 14 and receptive of objects such as pickles 15 (FIGS. 7 and 8) which must be pressed down within the jars and must then be immersed in a desirable liquid such as pickling brine.

Figures 9A, 9B:
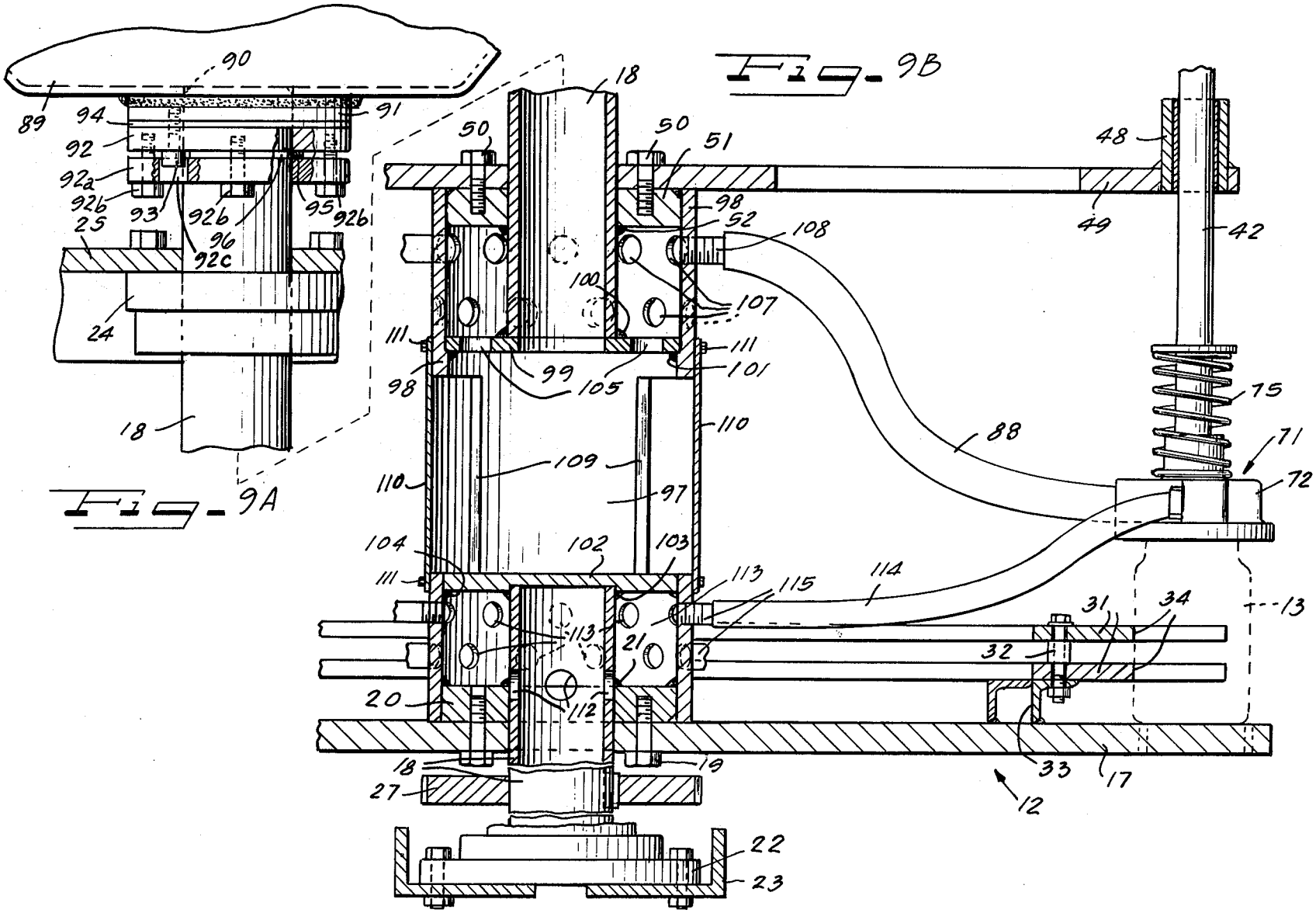
FIGS. 9*a* and 9*b* are related vertical fragmental sectional detail views taken substantially along the line IX—IX in FIG. 3.

In a preferred construction, the rotary carriage 12 comprises a horizontal base or heel plate 17 fixedly secured to a vertical central shaft 18 (FIGS. 9*a* and 9*b*) as by means of bolts by which the heel plate is attached to the underside of a collar 20 secured as by means of welding 21 to the shaft 18. Below the heel plate 17, the shaft 18 is rotatably supported by means of a thrust bearing structure 22 carried by and bolted to a fixed cradle 23 on a cross beam structure 23*a* (FIG. 2) of the frame 11. At the top of the frame 11, the shaft 18 is rotatably journaled in a bearing 24 mounted on and under a top or headplate 25 fixedly mounted on the top of the frame 11. Rotation of the carriage 12 is adapted to be effected through a pulley or sprocket 27 on the shaft 18 below the heel plate 17, and driven by means of an endless flexible driving member such as a sprocket chain 28 forming part of driving gear 29 powered by means of a motor 30.

For maintaining the containers 13 uniformly spaced on the radially outer marginal portion of the heel plate 17, the upper side of the heel plate carries a pair of adjacently vertically spaced, similar pocketed spacer ring plates 31 secured as by means of bolts 32 concentrically on the heel plate 17 through supporting angle bar means 33 welded to the heel plate. For receiving the containers 13 in equally spaced relation, the spacer rings 31 have concavely recessed spacer pockets 34 opening radially outwardly.

A continuous succession of the containers 13 is delivered to the rotary carriage 12 at an in-feed station by means of a conveyor system including a feed conveyor 35 (FIGS. 1, 2 and 3) which may be carried by the frame 11. Cooperating with the conveyor 35 is a lead-in helical screw spacer member 37 rotatably driven as by means of a worm gear drive 38 powered through the driving gear 29 synchronously with the conveyor 35 and the rotary carriage 12. From the spacer member 37 the containers 13 are successively delivered in properly spaced relation to a star wheel 39 by which the successive containers are shunted successively into the orientation pockets 34. The star wheel 39 is driven by the driving gear 29 synchronously with the conveyor 35, the lead-in helix 37 and the rotary carriage 12.

It will be understood that each of the containers 13 as delivered to the rotary carriage 12 has been loaded with the articles 15, e.g., pickles, but because of the nature of the articles, they must be firmed into the containers by pressing the articles down within the containers. For this purpose, the carriage 12 carries means in the form of plunger devices 40 equal in number to the pockets 34 and each comprising a presser foot 41 secured to the lower end of a plunger shaft 42 the upper or head end of which is equipped with a follower roller 43 riding in a cam track 44 in a cam ring 45 supported in stationary relation concentrically about the rotary carriage shaft 18 by means of a plurality, herein three equidistantly spaced mounting screws 47 supported by the frame headplate 25. Whereas the plungers 42 are suspended from the cam track ring 45, they are vertically guided in slide bearings 48 (FIGS. 2 and 7) fixedly supported by a guide bearing ring plate 49 fixedly carried in suitably vertically spaced relation above the heel plate 17 corotatably by the carriage shaft 18. For this purpose means comprising bolts 50 secure the central portion of the plate 49 to the top of a collar 51 secured as by means of welding 52 to the shaft 18.

Figures 3, 4, 5, 6:
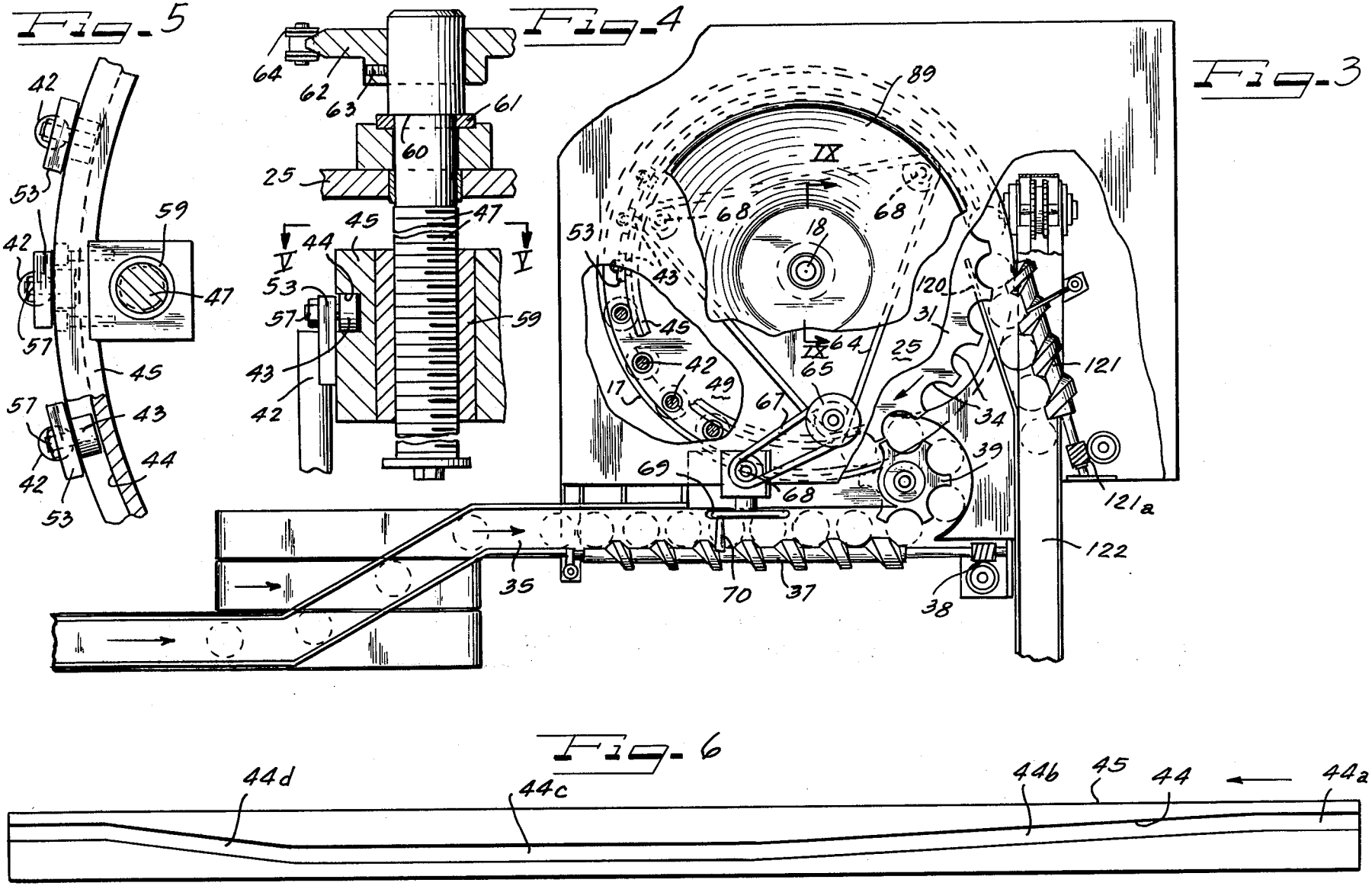
FIG. 3 is a top plan view of the machine.
FIG. 4 is a fragmentary enlarged vertical sectional detail view taken substantially along the lines IV—IV in FIG. 1.
FIG. 5 is a fragmentary horizontal sectional detail view taken substantially along the line V—V in FIG. 4.
FIG. 6 is a developed elevational view of the plunger reciprocating cam of the apparatus shown in FIGS. 1 and 2.

As the packing plungers 42 are advanced by the guiding carriage plate 49 in the rotation of the carriage 12, the cam groove 44 guides the plungers through the followers 43 in a cycle of reciprocation successively from a fully upwardly raised position wherein the presser pads 41 are located entirely above and clear of the top or mouth ends of the containers 13 wherein containers which have had the contents pressed down can be removed from the carriage to a position wherein the presser pads 41 are in the fully pressing relation within the mouth ends of the containers, and then returned. For this purpose, the cam track 44 has a succession of sections as shown in FIG. 6 comprising a retraction, highest section **44*a*, a plunger depressing transition section 44*b*, a fully plunger depressed section 44*c*, and a plunger retracting section 44*d* leading to the plunger fully retracted section 44*a*. The arrangement of the various sections of the cam track 44 are such that the presser pads of the plungers are moved into the containers newly delivered to the carriage 12 with a gradual descending pressing action to a predetermined depth within the mouths of the containers thereby pressing the articles in the containers to a maximum desired extent in which the plungers are retained for a sufficient length of time so that the articles remain wedged in the container below the upper edge thereof and more particularly below the customary shoulder below the container neck 14 so that as the presser pad of the plunger is then withdrawn, the articles will remain in their pressed-in wedged condition. In a preferred arrangement, the plunger pads remain engaged in pressing action with the contents of the containers in excess of one-half of the movement along the closed loop path of action in the rotation of the carriage 12. By preference, means are provided to prevent turning of the plungers 42, comprising for each of the plungers a headplate 53 set in a rabbet recess 54 formed in the upper end portion of the plunger shaft and secured thereto as by means of screws 55. The plates 53 face slidably against the outer perimeter of the cam track ring 45 and thus hold the plungers 42 against turning while nevertheless permitting free vertical reciprocations of the plunger shafts. In addition, the plates 53 provide a convenient means for mounting the follower rollers 43 by means of axles 57 secured as by means of nuts 58**.

Figure 2:
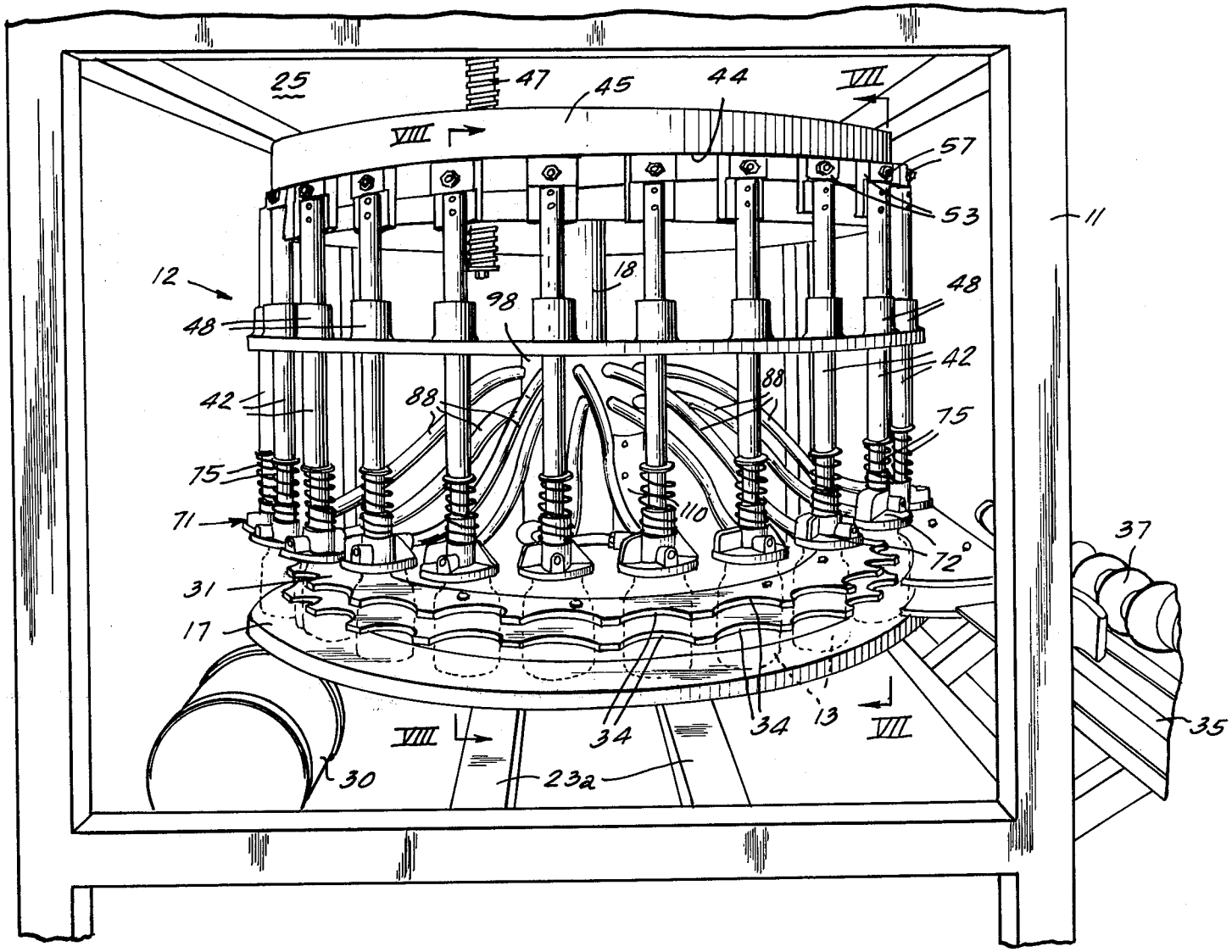
FIG. 2 is a side elevational view of the machine.

In order to accommodate containers of various heights from time to time in operation of the machine, means are provided for appropriately adjusting the elevation of the cam track ring 45 and thereby the lower limit of the stroking range of the presser plungers while nevertheless maintaining the same pressing stroke cycle. For this purpose, the supporting screw shafts 47 for the cam track ring 45 extend through respective threaded bushings 59 secured on the ring 45 so that as the screws 47 are turned, the ring 45 can be lowered or raised as desired. Above the head plate 25, each of the suspension and adjustment screws 47 is provided with a downwardly facing annular shoulder 60 engaging a thrust bearing 61 permitting free turning of the screw by means of a sprocket 62 secured to its head end as by means of a set screw 63. Conveniently, all of the sprockets 62 are coupled for synchronous rotation by means of a common endless sprocket chain 64 (FIGS. 3 and 4). To facilitate adjustment driving of the sprocket chain 64, one of the screw shafts has on its head end an adjustment sprocket 65 coupled by means of a sprocket chain 67 to a sprocket 68 driven through a suitable miter gear transmission through a crank 69 desirably in the form of a hand wheel provided with a handle 70 (FIGS. 1 and 3). Through this arrangement the entire array of the packing plunger assemblies 40 is adapted to be finely incrementally adjusted vertically for optimum performance for any height of the containers 13 for which the machine may be called upon to operate.

An important feature of the present invention resides in the provision for filling the containers 13 with a desired liquid, such as brine, concurrently with operation of the plunger pusher pads 41 pressing the articles 15 into the containers. To this end, means are provided which will operate automatically to deliver the liquid into the containers 13 as the plungers 42 drive the presser pads 41 down into the containers. A liquid delivery device 71 (FIGS. 1, 7 and 8) for this purpose comprises a body 72 which may be a casting of any suitable material such as stainless steel and slidably mounted for vertical reciprocation on a preferably reduced diameter lower end portion 73 of the plunger shaft 42 in each instance. On its lower face, the body 72 is of ample diameter to seat upon the upper end of the container neck 14 within a substantial range of neck lip end diameters to accommodate different neck diameters as may be desired to process from time to time. Liquid sealing contact with the lip of the neck 14 is assured by means of a resilient sealing ring facing gasket 74 carried by the lower face of the body 72.

Normally the delivery device body 72 is biased by means of a helical compression spring 75 toward and into sealing engagement with the upper side of the associated presser pad 41. For this purpose, the spring 75 is mounted concentrically about the plunger portion 73 and thrusts at its upper end against a thrust shoulder disk 77 retained in position against an offset shoulder 78 at juncture of the plunger portion 73 with the upper larger diameter portion of the plunger. At its lower end the spring 75 thrusts against an upwardly facing shoulder 79 on the body 72 and engages about an upwardly projecting centering neck 80 integral with the body 72 and carrying a guide bearing bushing 81 desirably provided with a pair of vertically spaced sealing O-ring members 82 which engage about the plunger portion 73. Within the body 72 above its lower face and below the bearing 81 is a liquid delivery chamber 83 which annularly surrounds the plunger portion 73 and in the inactive condition of the presser pad 41 is substantially sealed against escape of liquid by sealing engagement of a beveled annular sealing surface 84 about the mouth of the chamber 83 and a complementary beveled upper surface 85 on the presser pad. In a preferred arrangement the sealing surfaces 84 and 85 are lapped or otherwise finely finished to a thorough sealing engagement, providing a shut-off valve.

Figure 7:
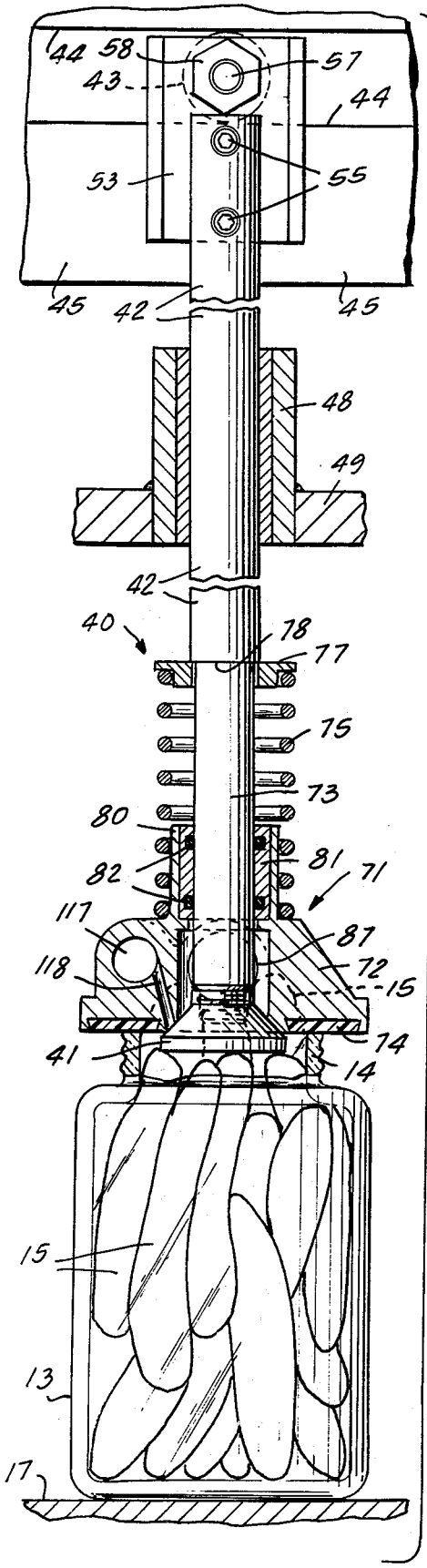
FIG. 7 is an enlarged fragmental sectional elevational view taken substantially along the line VII—VII in FIG. 2.
Figure 8:
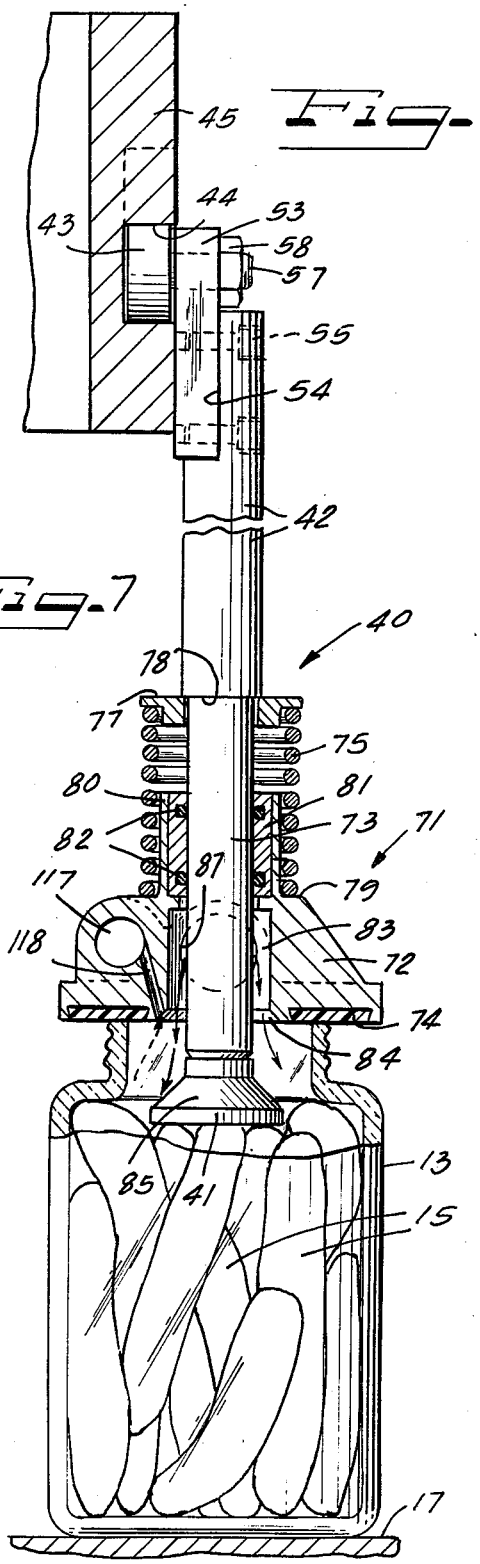
FIG. 8 is a fragmental vertical sectional detail view taken substantially along the line VIII—VIII in FIG. 2.

As the plunger assembly 40, in each instance, is lowered into article pressing relation to one of the containers 13, as best visualized in FIG. 7, the presser pad 41 first engages the upper ends of any of the articles 15 which may project above the lip of the neck 14 as is customary with hand loaded pickles. As the plunger descends, the presser pad 41 pushes the upwardly projecting articles down into the container and then enters the neck 14 to continue the pressing-in of the articles. As the presser pad 41 reaches the lip of the neck 14 and preferably after the leading end of the presser pad has actually entered a short distance into the neck 14, the lower face sealing ring 74 on the liquid delivery device body 72 sealingly engages the lip of the neck 14 and restrains the body 72 from travelling further toward the container 13 as the plunger 42 continues article pressing descent under the guidance of the cam track 44. As a result, the body 72 maintains a stationary position on the lip of the neck 14 as the plunger 42 continues its descent, the spring 75 yielding for this purpose, and the valve provided by the sealing surfaces 84 and 85 opening to permit liquid to flow from the chamber 83 freely into the container 13 past the presser pad 41 to fill the interstices between the articles 15 thereby to immerse the articles in the liquid within the container 13. Upon withdrawal of the plunger 42, and thereby the presser pad 41 from the container 13, the valve provided by the surfaces 84 and 85 automatically closes when the retracting presser pad 41 picks up the body 72.

Liquid supply to each of the delivery chambers 83 is conveniently effected to the entire battery array of the plunger assemblies 40 from a common source rotating with the carriage 12. To this end, each of the delivery device bodies 72 has a supply port 87 into the chamber 83 and to which leads a conduit 88 (FIGS. 2 and 9b) communicating with a liquid supply reservoir which is desirably a part of the shaft 18 which is of substantial diameter and hollow. In order to make the machine 10 self-contained as to liquid supply, a large capacity tank 89 (FIGS. 1, 3 and 9a) is mounted corotatively with and on the upper end of the shaft 18. In a typical pickle packing machine the tank 89 may be a spun stainless steel bowl of on the order of 90 gallon brine capacity. Liquid from the tank 89 is adapted to flow freely by gravity through a bottom port 90 into the upper end of the hollow shaft 18. In order to permit mounting of the tank 89 on the upper end of the shaft 18 and removal of the tank when desired, attachment means comprise a disk 91 secured as by means of welding to the bottom of the tank 89 concentric with the port 90 and providing means for bolting the coupling disk 91 to a coupling flange 92 as by means of bolts 93. A resilient sealing gasket 94 is squeezed between the ring disk 91 and the ring flange 92 and provides a liquid seal embracing the shaft 18, and permits the coupling to be received slidably on the shaft. A supporting shoulder for the tank coupling is provided by a snap ring 95 mounted in a groove 96 in the upper end portion of the shaft 18 at such an elevation that when the coupling ring flange 92 rests on the shoulder snap ring 95, the upper end lip of the hollow tubular shaft 18 will lie flush with or slightly below the base surface of the tank 89 for free flow of liquid into the shaft. To hold the tank 89 positively against displacement and to assist in maintaining the tank corotative with the shaft 18, a clamping ring flange **92*a* is secured as by means of bolts 92*b* to the underside of the ring flange 92 and clamps the shoulder ring 95 between the disks 92 and 92*a*. The heads of the bolts 93 project down into sockets 92*c* in the upper face of the ring flange 92*a*. When it is desired to remove the tank 89 for any reason, the ring flange 92*a* is unfastened by removing the bolts 92*b*, whereupon the tank 89 can be lifted upwardly by sliding the coupling flanges 91 and 92 together with the sealing gasket 94 upwardly from the shoulder ring 95 and free from the shaft 18. This arrangement, it will be appreciated, also facilitates assembly of the shaft 18 through the top plate 25 in the first instance by moving it into position upwardly through the bearing 24, then mounting the shoulder snap ring 95 in the groove 96, whereafter the tank 89** is adapted to be mounted on the upper portion of the shaft.

From the supporting coupling with the bottom of the tank 89, the shaft extends downwardly through the top plate 25 and the bearing 24 to the plunger guide plate supporting collar 51, with a portion of the shaft extending below the collar 51 and opening into a reservoir 97 within a tubular vertical manifold member 98 secured at its upper end as by means of welding to the collar 51 and extending downwardly to a substantial length and having secured thereto as by means of welding the collar 20 which is welded to the lower portion of the shaft 18. At its lower end the upper portion of the shaft 18 is spaced above the top end of the lower portion of the shaft and has a lateral flange 99 which may be a separate annular disk secured thereto as by means of welding 100. The disk 99 is of a diameter to engage the wall of the manifold member 98 to which it is adapted to be welded as indicated at 101 whereby to provide a stabilizer for the upper portion of the shaft. At its lower end, the reservoir 97 is closed off by means of a closure disk 102 conveniently secured as by means of welding 103 to the top end of the lower portion of the shaft 18, and also secured as by means of welding 104 to the wall of the manifold member 98. Liquid supplied by gravity through the hollow upper end portion of the shaft 18 into the reservoir 97 is adapted to pass by way of a plurality of free flow apertures 105 in the disk 99 to an array of ports 107 through the wall of the manifold member 98 in the area thereof between the collar 51 and the stabilizer disk 99 and in communication with which ports the ducts 88 are respectively coupled in a suitable manner such as by means of nipples 108. Through this arrangement, all of the ducts 88 are continuously supplied gravitationally with liquid which is supplied under continuous gravitational hydrostatic head pressure to the respective chambers 83 in the liquid delivery heads 72. To permit convenient clean-out of the reservoir 97, the manifold member 98 is provided with one or more clean-out openings 109 in its wall which are normally closed by means of closure panels 110 removably secured to the outside of the manifold member 98 as by means of screws 111.

That portion of the hollow shaft 18 which is below the horizontal closure partition 102 within the manifold member 98, is utilized as an air bleedoff and overflow device for the liquid delivering devices 71. For this purpose, the upper end portion of the lower section of the shaft 18 which traverses the space between the collar 20 and the closure partition 102 is provided with an annular series of circumferentially spaced discharge ports 112 communicating with a collection chamber 113 defined between the collar 20 and the partition 102 and the lower wall portion of the manifold member 98. Communicating through an array of ports 113 in that portion of the wall of the manifold 98 which defines the chamber 113 are respective bleedoff and overflow flexible ducts 114 connected with the respective ports 113 by means of nipples 115 and coupled in communication at their opposite ends with respective bleedoff and overflow passages 117 each of which is connected by means of a small diameter limited flow area bleedoff passage bore 118 with the oblique valve surface 84 of the associated delivery device head 72. Through this arrangement, air within the container 13 displaced by liquid delivered into the container during a contents compacting operation is adapted to escape as shown by the dashed arrow in FIG. 8 through the associated bleed bore 118. Because of the small size of the entrance into the bore 118 escaping air will preferentially bleed off and escape through the bleedoff route and only a minimal amount of the liquid may tend to escape with the air or after the container has been filled with liquid and until the compressor pad valve surface 85 closes off against the delivery device body valve surface 84. However, as the pad 41 retracts it, in effect, creates a displacement suction into the container which tends to inhibit escape of liquid through the bleed duct bore 118. When the valve surfaces 84 and 85 are in the closed contact (FIG. 7), the entrance to the bleedoff bore 118 is sealed from the liquid delivery chamber 83. Any liquid that does escape by way of the bleed ducts 114 into the chamber 113 runs out of the bottom of the chamber through the ports 112 which are located in the tubular shaft 118 at a level which is partially below the level of the top surface of the collar 20 forming the bottom of the chamber 113. Escaping bleedoff liquid may be salvaged by collecting it in a sump such as a container 119 (FIG. 1) placed below the lower open end of the shaft 18.

To assure that a desirable expansion air space will remain in the top of the filled container 13 in each instance, such as in pickle packing, the lowermost portion of the presser pad 41 in each instance extends a desirable limited distance below the lower face of the liquid delivery device body 72 after the valve 84,85 has been closed, substantially as seen in FIG. 7. Thereby, as the presser foot or pad 41 is retracted from within the container following the pressing-in stroke, liquid can fill in over the articles 15 and in the neck 14 up to the point where the valve 84,85 closes, just before the liquid delivery device body 72 is lifted from the container. Therefore, that portion of the presser pad 41 which projects below the lower face of the member 72 provides sufficient displacement within the upper end of the container which is not filled in with liquid to leave the desired air space. It will be appreciated that inasmuch as the articles 15 such as pickles have been compacted into the respective jar 13 below the customary shoulder at the bottom end of the neck 14, such shoulder will substantially hold the compacted contents against spring-back, and therefore the contents will be thoroughly immersed within the liquid that has been filled into the container, while nevertheless leaving the desired expansion air space which will remain after the container has been capped.

In operation, the containers 13 are advanced seriatim at the in-feed station to and along the infeed conveyor 35 to the helical spacer screw device 37 from which the spaced advancing containers are taken by the star wheel 39 and delivered to the carriage 12 for advance through the contents pressing-in and liquid filling cycle by action of the plunger assemblies 40 and the automatic liquid delivery devices 71 carried by the plunger assemblies. At completion of the pressing-in and liquid filling cycle, the containers are shunted from the rotating carriage 12 at a take-away station as by means of a shunting bar 120 (FIG. 3) and maintained in spaced relation against colliding by means of a takeoff helical spacer screw device 121 driven by a suitable driving connection such as a worm gear device **121*a* synchronously with operation of the other coordinated moving devices of the machine. From the takeoff spacer 121, the containers 13 leave the machine by way of a takeway conveyor 122**.

It will be understood that variations and modifications may be effected without departing from the spirit and scope of the novel concepts of this invention.

I claim as my invention:

1. Apparatus for packing articles in open top containers and concurrently filling the containers with liquid, comprising, in combination:

a supporting frame structure;

a rotary device having a hollow vertical shaft rotatably journaled on said frame structure;

liquid supply means communicating with the interior of the hollow shaft;

means for supporting and transporting a series of the open top containers between a container infeed station and an adjacent container takeaway station;

an array of vertically reciprocable plungers carried by said device for operation in the course of rotation of the device in alignment with predetermined container supporting positions on said container supporting and transporting means and having lower end presser foot pads and upper end means for effecting cyclical downward pressing strokes of the plungers wherein the presser pads push articles down into aligned containers in said positions, and reverse retracting strokes wherein the plungers are retracted upwardly and the presser pads withdrawn from the containers;

and means communicating with the hollow shaft for delivering article immersing liquid into the containers while the respective plungers are operated in their pressing strokes.

2. Apparatus according to claim 1, wherein said hollow shaft has a reservoir manifold, and flexible ducts communicating with said manifold and respective liquid delivery devices carried by the plungers.

3. Apparatus according to claim 2, wherein said manifold includes bleedoff passage means, and flexible ducts effecting communication between said bleedoff passage means and bleedoff passages in said liquid delivery means.

4. Apparatus according to claim 1, including a vertically adjustable cam track arranged in a generally horizontally disposed closed loop, said plungers comprising assemblies movable in a closed loop path below the cam track and each having means at its upper end in tracking engagement with the cam track such that movement of each plunger assemby in the closed loop path during rotation of the device causes the reciprocal movement of each of the plungers, the shape of the cam track and the tracking engagement between the track, and the tracking means of the plungers being such that the presser pad of each of the plungers is engaged in article pressing relation within each of the containers in excess of one-half of the movement of the plunger assembly along the closed loop path in each instance, and means for vertically adjusting said cam track and thereby vertically adjusting the plunger assemblies for accommodating containers of different heights, said adjusting means comprising adjusting screws supporting said cam track and means for simultaneously operating said adjusting screws.

5. Apparatus according to claim 1, wherein said liquid delivering means comprise a chambered delivery device body mounted reciprocably on each of said plungers, said pressure pads and said delivery device bodies having cooperating valve surfaces. biasing spring means normally biasing said delivery device bodies toward the presser pads to close the valve surfaces, said delivery device bodies having downwardly facing sealing surfaces engageable against the lips of container tops and operating to hold the delivery device bodies stationary on the containers during pressing in stroke of the associated plungers so that as the respective presser pads move away from the delivery device bodies the valve surfaces are separated for delivery of liquid from the delivery device bodies into the associated container, said valve surfaces closing in liquid shut-off engagement as the respective plungers are retracted, and each of said presser pads having a portion which projects downwardly from the lower contact face of the delivery device body to serve as an air space displacement device after the valve has closed to maintain an air space in the upper portion of the container after the plunger has been retracted to withdraw the pressure pad from the top of the container.

6. Apparatus according to claim 1, wherein said liquid supply means comprise a tank above said frame structure from which liquid is supplied into the upper end portion of the shaft.

7. Apparatus according to claim 6, including means removably supporting the tank on an upward projection of said upper end portion of said shaft.

8. Apparatus according to claim 1, including thrust bearing means supported by a lower portion of said frame structure and rotatably supporting the lower end of said shaft, and journaling bearing means carried by an upper portion of the frame structure and through which an upper end portion of the shaft is rotatably journaled, an upper extremity of the shaft projecting upwardly above said journaling bearing means and in communication with said liquid supply means.

9. Apparatus according to claim 1, comprising means for bleeding off air from within the containers as air is displaced by the liquid, means for closing the tops of the containers during pushing of articles and filling of the containers with liquid, said means for bleeding off air comprising a restricted bleedoff passage leading through said closing means, and said closing means maintaining the container tops closed while the plungers are retracted upwardly and thereby effecting a suction, inhibiting escape of liquid through said bleedoff passage while the liquid fills in the space within the container from which the presser pad is withdrawn.

10. Apparatus for packing articles in open top containers and concurrently filling the containers with liquid, comprising, in combination:

a supporting frame structure;

a rotary carriage having a hollow vertical shaft rotatably journaled on said frame structure;

liquid supply means communicating with the interior of the hollow shaft;

means on the carriage for supporting and transporting a series of the open top containers between a container infeed station and an adjacent container takeaway station;

an array of vertically reciprocable plungers carried by said carriage aligned with predetermined container supporting positions on said container supporting means and having lower end presser foot pads and upper end means for effecting cyclical downward pressing strokes of the plungers wherein the presser pads push articles down into the aligned containers, and reverse retracting strokes wherein the plungers are retracted upwardly and the presser pads withdrawn from the containers, in the course of rotation of the carriage to carry the containers successively from said infeed station to said take-away station;

and means communicating with the hollow shaft for delivering article immersing liquid into the containers while the respective plungers are operated in their pressing strokes.

11. Apparatus according to claim 10, wherein said hollow shaft has a reservoir manifold, and flexible ducts communicating with said manifold and respective liquid delivery devices carried by the plungers.

12. Apparatus according to claim 11, wherein said manifold includes bleedoff passage means, and flexible ducts effecting communication between said bleedoff passage means and bleedoff passages in said liquid delivery means.

13. Apparatus according to claim 10, including a vertically adjustable cam track arranged in a generally horizontally disposed closed loop, said plungers comprising assemblies movable in a closed loop path below the cam track and each having means at its upper end in tracking engagement with the cam track such that movement of each plunger assembly in the closed loop path during rotation of the carriage causes the reciprocal movement of each of the plungers, the shape of the cam track and the tracking engagement between the track and the tracking means of the plungers being such that the presser pad of each of the plungers is engaged in article pressing relation within each of the containers in excess of one-half of the movement of the plunger assembly along the closed loop path in each instance, and means for vertically adjusting said cam track and thereby vertically adjusting the plunger assemblies for accommodating containers of different heights, said adjusting means comprising adjusting screws supporting said cam track and means for simultaneously operating said adjusting screws.

14. Apparatus according to claim 10, wherein said liquid delivering means comprise a chambered delivery device body mounted reciprocably on each of said plungers, said pressure pads and said delivery device bodies having cooperating valve surfaces, biasing spring means normally biasing said delivery device bodies toward the presser pads to close the valve surfaces, said delivery device bodies having downwardly facing sealing surfaces engageable against the lips of container tops and operating to hold the delivery device bodies stationary on the containers during pressing in stroke of the associated plungers so that as the respective presser pads move away from the delivery device bodies the valve surfaces are separated for delivery of liquid from the delivery device bodies into the associated container, said valve surfaces closing in liquid shut-off engagement as the respective plungers are retracted, and each of said presser pads having a portion which projects downwardly from the lower contact face of the delivery device body to serve as an air space displacement device after the valve has closed to maintain an air space in the upper portion of the container after the plunger has been retracted to withdraw the pressure pad from the top of the container.

15. Apparatus according to claim 10, wherein said liquid supply means comprise a tank above said frame structure from which liquid is supplied into the upper end portion of the shaft.

16. Apparatus according to claim 15, including means removably supporting the tank on an upward projection of said upper end portion of said shaft.

17. Apparatus according to claim 10, including thrust bearing means suported by a lower portion of said frame structure and rotatably supporting the lower end of said shaft, and journaling bearing means carried by an upper portion of the frame structure and through which an upper end portion of the shaft is rotatably journaled, an upper extremity of the shaft projecting upwardly above said journaling bearing means and in communication with said liquid supply means.

18. A method of packing articles into open top containers and concurrently filling liquid into the containers, comprising:

pushing the articles downwardly into the containers; during such pushing of the articles substantially filling the containers with article immersing liquid;

bleeding off air through restricted bleedoff passages from within the containers as the air is displaced by the liquid;

closing the tops of the containers during said pushing of the articles and filling the containers with liquid;

effecting the pushing of the articles by driving of presser pads into the tops of the containers and then retracting the presser pads while the container tops are maintained closed and thereby effecting a suction which inhibits escape of liquid through said bleedoff passage while the liquid fills in the space within the containers from which the presser pads are withdrawn.

19. A method according to claim 18, including maintaining an air space in the top of the container after the substantial filling of the container with the liquid.

20. A method according to claim 18, comprising driving a plunger carried presser pad downwardly into the open top of the container to effect said pushing of the articles and automatically operating a liquid delivering device carried by the presser pad carrying plunger by contacting the device with the top of the container to effect said filling of the container with liquid.

21. A method according to claim 20, comprising supplying the liquid delivery device gravitationally with liquid from a supply reservoir.

22. A method according to claim 18, wherein said articles comprise pickles which have been loaded into the container and project partially thereabove, pushing the pickles fully into the container and substantially filling the container with brine as the liquid while the pickles are being pushed down into the container.

* * * * *